United States Patent [19]

Ikura et al.

[11] 3,988,987

[45] Nov. 2, 1976

[54] COMBINATION STAMP

[75] Inventors: Kenichiro Ikura, Osaka; Nobukazu Sakamoto, Osaka; Tetsuo Koyama, Kyoto; Masaru Miyazaki, Osaka, all of Japan

[73] Assignee: Yamauchi Rubber Industry Co., Ltd., Osaka, Japan

[22] Filed: Oct. 23, 1974

[21] Appl. No.: 517,385

[30] Foreign Application Priority Data

| | | |
|---|---|---|
| Oct. 23, 1973 | Japan | 48-122972[U] |
| Apr. 15, 1974 | Japan | 49-42462[U] |
| June 11, 1974 | Japan | 49-68198[U] |
| June 22, 1974 | Japan | 49-73710[U] |
| Sept. 13, 1974 | Japan | 49-111317[U] |

[52] U.S. Cl. ..... 101/327; 35/69; 101/368; 101/381

[51] Int. Cl.[2] ..... B41F 31/02

[58] Field of Search ..... 35/69, 71; 101/368, 101/369, 370, 371, 373, 380, 381, 379, 405, 372, 327, 333; 222/399

[56] References Cited

UNITED STATES PATENTS

| | | | |
|---|---|---|---|
| 465,754 | 12/1891 | Clarkson | 101/374 |
| 1,079,061 | 11/1913 | Pannier | 101/376 |
| 1,176,204 | 3/1916 | Crabbs | 101/398 |
| 1,739,110 | 12/1929 | Wheeler | 101/381 |
| 1,920,058 | 7/1933 | Buck | 101/380 X |
| 2,794,579 | 6/1957 | McKernan | 222/399 |
| 2,819,668 | 1/1958 | McAneny | 101/368 X |
| 2,857,839 | 10/1958 | Jamieson | 101/405 X |
| 2,899,895 | 8/1959 | Tannery | 101/381 |
| 3,380,380 | 4/1968 | Funahashi | 101/379 |
| 3,442,209 | 5/1969 | Funahashi | 101/380 |
| 3,478,682 | 11/1969 | Funahashi | 101/368 X |
| 3,756,153 | 9/1973 | Cohen | 101/368 |

OTHER PUBLICATIONS

IBM Tech. Disc. Bull., "Quick Change Imprinting," Johnson and Leach, Mar. 1971, vol. 13, No. 10. 101-382

*Primary Examiner*—Edgar S. Burr
*Assistant Examiner*—Paul J. Hirsch

[57] ABSTRACT

Combination stamp comrpises a plurality of independent stamp elements joined together for use in combination. The stamp element includes a stamp frame having a stamp plate at its lower end and a top wall and four side walls. A dovetail-like vertical projection is formed on one of the opposing side walls and a dovetail-like vertical groove in the other side wall. Engagement of the projection in the groove joins adjacent stamp elements together against horizontal displacement. Each of the other opposing side walls has a horizontal groove in its upper portion. The joined stamp elements are so adjusted that the horizontal grooves therein are in alignment with each other, and a cover having inward projections along the opposite side edges thereof is fitted over the stamp elements, with the inward projections engaged in the aligned horizontal grooves, whereby the stamp elements are prevented from vertical displacement.

4 Claims, 11 Drawing Figures

Fig. 1
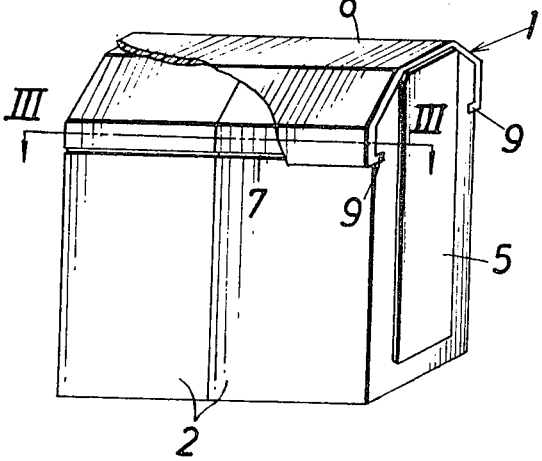
Fig. 2
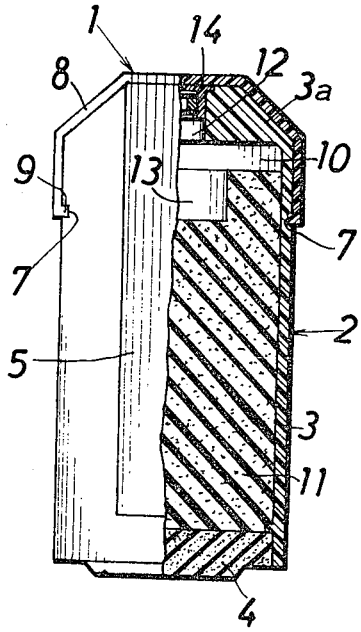
Fig. 3
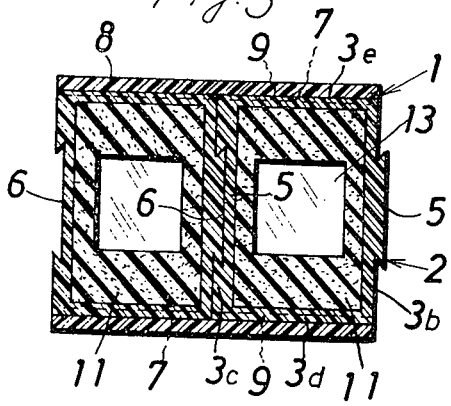
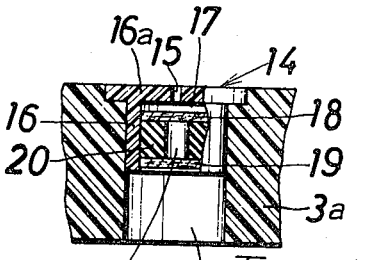
Fig. 4
Fig. 5
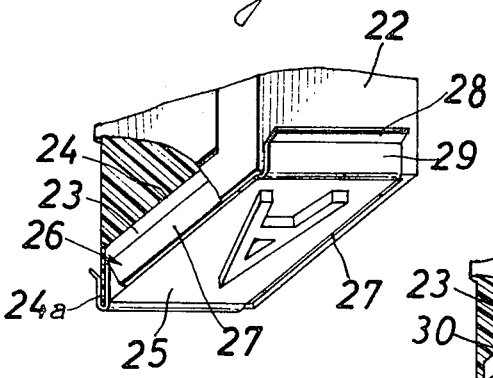
Fig. 6
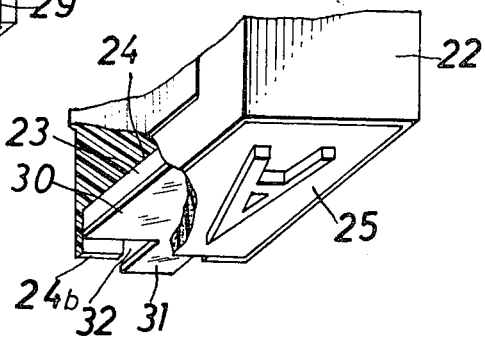

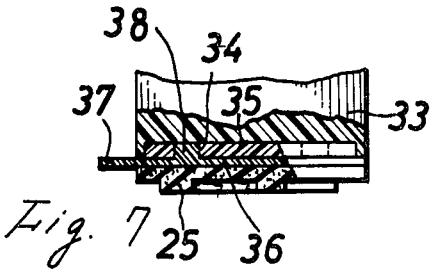
Fig. 7
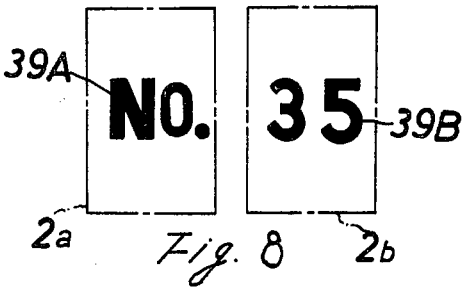
Fig. 8
Fig. 9
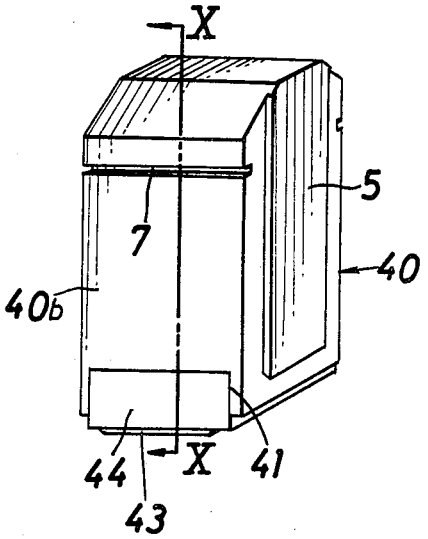
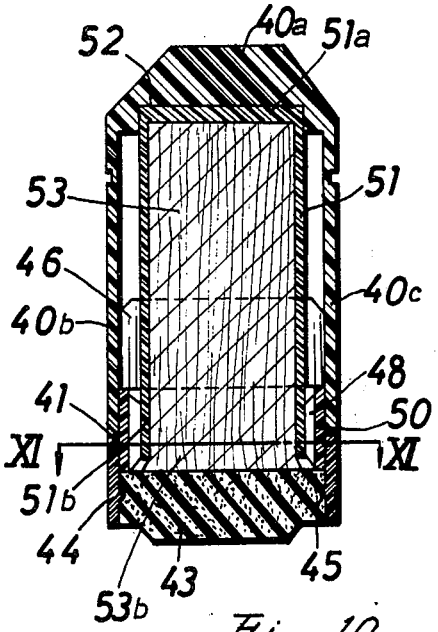
Fig. 10
Fig. 11
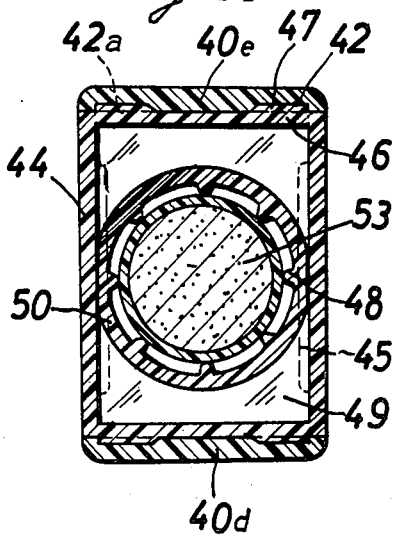

COMBINATION STAMP

BACKGROUND OF THE INVENTION

The present invention relates to a combination stamp, more particularly to a stamp comprising a plurality of independent stamp elements joined together for use in the desired combination.

Throughout the specification and claims, the term "character" or "characters" is to be construed as inclusive of numerals, symbols and graphic figures.

Apparently it is more advantageous to prepare stamp elements as divided into character units so as to obtain a specified arrangement of characters using the stamp elements in the desired combination than to prepare a number of stamps each having a specified arrangement of characters. However, if one stamp element gets displaced vertically relative to another in the combination of stamp elements, a difference occurs in the density of stamp images between the character units, whilst horizontal displacement of the stamp elements relative to each other disturbs the arrangement of characters. It is therefore desired to provide a combination stamp in which stamp elements can be joined together in orderly arrangement to overcome the abovementioned problems.

SUMMARY OF THE INVENTION

The present invention provides a combination stamp which has overcome the foregoing problems and which comprises stamp elements each including a stamp frame and a stamp plate provided in the lower end of the stamp frame, the stamp frame having a vertical interlocking projection on one of its opposite side surfaces and a vertical interlocking groove in the other side surface, and a holding member removably mountable over the stamp elements to be used in combination to prevent displacement of the stamp elements relative to each other. The adjacent stamp elements are joined together by the engagement between the projection and the groove of the opposing surfaces thereof, and the holding member is then fitted over the joined stamp elements. The engagement of the projection with the groove prevents horizontal displacement of the stamp elements relative to each other, while the holding member fitted over the joined stamp elements precludes vertical displacement of the elements, whereby the stamp elements can be joined together in orderly arrangement. The construction assures that if a great number of such stamp elements are prepared, characters will be stamped in orderly desired arrangement under uniform pressure exactly in the same manner as a conventional single stamp to produce a beautiful stamp image.

This invention will be described below in greater detail with reference to the accompanying drawings.

BRIEF DESCRIPTION OF THE DRAWINGS

FIG. 1 is a perspective view showing an embodiment of the combination stamp of this invention, with a cover-like holding member partly broken away, FIG. 2 is a side elevation partly broken away to show the combination stamp of FIG. 1;

FIG. 3 is a view in section taken along the line III—III in FIG. 1;

FIG. 4 is an enlarged view in vertical section showing an ink supply inlet portion of a stamp frame;

FIG. 5 is a fragmentary perspective view of the stamp element, the stamp frame being partly broken away to show a detachably mountable stamp plate;

FIG. 6 is a fragmentary perspective view corresponding to FIG. 5 and showing a modification of the construction for detachably mounting the stamp plate;

FIG. 7 is a fragmentary view partly in vertical section to show another modification of the construction for detachably mounting the stamp plate;

FIG. 8 shows a stamp image obtained by using the combination stamp of this invention;

FIG. 9 is a perspective view showing a modification of stamp element;

FIG. 10 is a view in section taken along the line X—X in FIG. 9; and

FIG. 11 is a view in section taken along the line XI—XI in FIG. 10.

DESCRIPTION OF THE PREFERRED EMBODIMENTS

With reference to FIGS. 1 to 3, a combination stamp 1 includes a plurality of stamp elements 2, each of which comprises a stamp frame 3 in the form of a tube having a rectangular or square cross section and made of synthetic resin and a stamp plate 4 made of microporous sponge and fitted in the lower end of the stamp frame 3. The stamp frame 3 comprises a thick top wall **3*a* having a planar top surface and slanting surfaces extending from the opposite sides of the top surface and four side walls 3*b*, 3*c*, 3*d* and 3*e*. The side wall 3*b* is formed, at the midportion of its outer surface, with a dovetail-like vertical interlocking projection 5 extending from the upper end of the wall almost to its lower end. A dovetail-like vertical interlocking groove 6 corresponding to the projection 5 is formed in the midportion of outer surface of the side wall 3*c*. A horizontal groove 7 is formed in each of the side walls 3*d* and 3*e* in the upper portion of its outer surface. The vertical projection 5 is fitted into the vertical groove 6 to join adjacent stamp elements 2 against horizontal displacement. To prevent the displacement of the stamp elements 2 thus joined together from each other in a vertical direction, a cover-like holding member 8 made of synthetic resin is fitted over the stamp elements 2. The holding member 8 is in the form of a channel member having a length corresponding to the length of row of the stamp elements 2 to be fitted together in combination and so shaped as to fit over the top walls of the stamp elements 2 and extend therefrom to the upper portions of the opposite sides thereof. The holding member 8 has inward projecting portions 9 at its opposite side edges. After the horizontal grooves 7 of the joined stamp elements 2 are aligned with each other, the inward projections 9 of the holding member 8 are fitted into the horizontal grooves 7, whereby the retaining member 8 is fitted over the joined stamp elements 2. The engagement of the inward projections 9 in the aligned horizontal grooves 7 prevents vertical displacement of the stamp elements 2** relative to each other.

The hollow interior of the stamp frame 3 serves as an ink reservoir 10 which is packed with an ink retaining member 11 made of open cellular foamed synthetic resin, with a small space provided between the top wall 3a and the retaining member 11. The lower end of the retaining member 11 is in contact with the stamp plate 4. Alternatively, the ink retaining member may be made of nonwoven fabric. A recess 13 opposing an ink supply inlet 12 is formed in the top portion of the ink retaining member 11. Ink is poured in from the inlet 12 and is first retained in the recess 13, from which the ink seeps through the retaining member 11. Consequently, the top surface of the retaining member 11 will not be entirely covered with a layer of ink. This assures prompt replacement of air by ink in the retaining member 11, thereby permitting rapid replenishment of ink. The retaining member 11 can be thoroughly impregnated with ink, therefore. A cap 14 is fitted in the ink supply inlet 12.

FIG. 4 shows the construction of the cap 14 in detail. The cap 14 comprises a tubular main body 16 having a top wall 16*a* formed with an air port 15, an annular elastic member 20 made of rubber and forced into the main body 16 with a space 17 provided between the top wall 16*a* and the elastic member 20, and air-permeable but liquid impermeable layers 18 and 19 adhered to the upper and lower surfaces of the elastic member 20 with adhesive. The air-permeable liquid-impermeable layers 18 and 19 are made of polyfluoroethylene fibers which are entangled into a sheet resembling paper or nonwoven fabric and having a porosity of at least 50 to 85% and pore sizes of at least 100 $\mu$. Because of the properties of polyfluoroethylene, the layers 18 and 19 are highly impermeable to ink which is a liquid having high surface tension. Thus air freely passes through the air port 15, upper air-permeable liquid impermeable layer 18, a space 21 in the annular elastic member 20 and lower air-permeable liquid-impermeable layer 19 to always keep the internal pressure at the same level as the atmospheric pressure and to thereby assure smooth outflow of ink for stamping, whereas ink in the reservoir 10 is prevented from leaking through the supply inlet 12. Even if ink should pass through the lower air-permeable liquid-impermeable layer 19 when the stamp element 2 is turned upside down, the ink will be retained in the space 21 and completely prevented from leaking. The ink thus retained in the space 21 is returned to the ink reservoir 10 by virtue of ventilation caused by changes in temperature at the inlet 12.

Although the stamp plate shown in FIG. 2 is fixed to the lower end of the stamp frame 3 and is not detachable, the stamp element shown in FIG. 5 has a stamp plate 25 which is removably attached to a stamp frame 22 and is therefore replaceable. Formed in the lower end of the stamp frame 22 is a rectangular recess 24 having a permanent magnet 23 on its bottom. The stamp plate 25 is shaped in conformity with the recess 24 and made a microporous sponge to be impregnated with ink. The stamp plate 25 is provided, on its upper surface, with a magnetic plate 26 made of a rigid body and having an identical shape with the stamp plate 25. Generally, the magnetic plate is made of iron but the material is not limited to iron. The magnetic plate 26 has a pair of downwardly extending gripping portions 27 for holding the opposite sides of the stamp plate 25 and a pair of engaging portions 29 U-shaped in cross section and each having an outwardly extending grasping end 28. The engaging portions 29 are fitted over the opposite walls 24a defining the recess 24. The stamp plate 25 is joined with the magnetic plate 26, and this assembly is fitted into the recess 24. By the magnetic plate 26 being attracted to the magnet 23, the stamp plate 25 is fixed to the stamp frame 22.

FIG. 6 shows a modification of the above construction for detachably mounting the stamp plate. This modified embodiment has a planar magnetic plate 30 of the same size as the stamp plate 25. A knob 31 extends from one side of the plate 30. The magnetic plate 30 is adhered to the upper surface of the stamp plate 25. One side wall 24b defining the recess 24 is formed with a cutout 32 for the knob 31 to extend outward from the stamp frame 22 when the stamp plate 25 is fitted into the recess 24.

FIG. 7 shows another modification of the construction for detachably mounting the stamp plate, in which the recess for accommodating the stamp plate is not formed in a stamp frame 33. A magnet 35 having at least one position-determining bore 34 is inlaid in the lower end of the stamp frame 33 to render the lower end of the frame 33 planar. A magnetic plate 36 adhered to the upper surface of the stamp plate 25 has the same shape as the above-mentioned magnetic plate 30 and is provided with a knob 37. In addition, the magnetic plate 36 has at least one upstanding projection 38 to be fitted into the bore 34. Conversely, the stamp frame may be provided with a magnetic member, with a magnet adhered to the stamp plate. Further alternatively, each of the frame and stamp plate may be provided with a magnet.

FIG. 8 shows stamp images produced by the combination of two stamp elements. Indicated at 39A is a stamp image obtained by one stamp element 2*a* and at 39B, a stamp image produced by the other stamp element 2*b*. It will be apparent from FIG. 8 that various arrangements of characters are available by replacing one of the two stamp elements. Of course the number of stamp elements is not limited to two but an increased number of stamp elements are usable in combination insofar as the assembly can be handled by the hand. This depends on the size of the stamp element. The length of the holding member is determined in accordance with the length of row of the stamp elements in combination. The stamp elements need not necessarily have the same size but as far as they are uniform in the width of the opposite walls 3*b* and 3*c*, the width of the opposite walls 3*d* and 3*e* is variable as desired (see FIG. 3). If the stamp elements differ from each other in size, the detachably mountable stamp plates shown in FIGS. 5 to 7 are advantageous to use.

FIGS. 9 to 11 show a modified embodiment of the stamp element which includes an ink cartridge. A stamp frame 40 is in the form of a tube having a square to rectangular cross section and including a thick top wall 40*a* and four relatively thin side walls 40*b*, 40*c*, 40*d* and 40*e*. A rectangular cutout 41 is formed in the lower end of each of the opposing side walls 40*b* and 40*c*. Each of the other opposing side walls 40*d* and 40*c* is formed in its inner surface with two parallel vertical grooves 42 extending approximately from its lower end upward beyond the cutout 41. A stamp plate 43 made of microporous sponge is forced into a rectangular synthetic resin tube 44 having slight elasticity and detachably mountable in the lower end of the stamp frame 40. The stamp plate 43 is adapted to be retained in position by horizontal projections 45 formed on the inner surfaces of a pair of opposing walls of the tube 44. The other two opposing walls of the tube 44 for holding the stamp plate are provided with extensions 46 in face-to-face relation to the opposing side walls 40*d* and 40*e* of the stamp frame 40. Formed on the outer surface of the extension 46 are vertical projections 47 extending almost to the lower end of the tube 44 and fittingly engageable in the vertical grooves 42. The opposing walls of the stamp plate holding tube 44 are inserted into the cutouts 41 and the projections 47 on the other pair of opposing walls having the extensions 46 are inserted into the grooves 42, whereby the tube 44 is placed in the stamp frame 40. The projections 47 are fitted into the grooves 42 beyond small stepped portions 42*a* provided in the lower ends of the grooves 42, so that the holding tube 44, once placed into the stamp frame 40, can be retained in position. The portions exposed from the cutouts 41 are gripped and then withdrawn to remove the holding tube 44 from the stamp frame 40. A cylinder 50 for supporting a cartridge is disposed in and slightly projects upward from the rectangular tube 44. The cylinder 50 is formed on its inner peripheral surface with a number of projections 48 at equal spacing and has at its lower end a flange 49 to be placed on the stamp plate 43. An ink cartridge 51 made of synthetic resin and in the form of a round tube has a top wall 51*a* and a lower end 51which is surrounded and supported by the projections 48 on the cylinder 50. The top wall 51*a* is fitted into a circular cavity 52 in the lower surface of top wall 40*a* of the stamp frame 40. The cartridge 51 is packed with an ink retaining member 53 made of felt. The lower end 53*b* of the ink retaining member 53 extends downward from the cartridge 51 and is in contact with the upper surface of the stamp plate 43 to transfer ink from the retaining member 53 onto the stamp plate 43. To replace the cartridge 51, the holding tube 44 is removed from the stamp frame 40 first, and the cartridge 51 is then withdrawn from the cylinder 50.

The present invention can be practiced in other different modes without departing from the spirit and basic features of the invention. Thus the examples therein disclosed are given for illustrative purposes only and is not limitative in any way. The scope of this invention is defined by the appended claims rather than by the above specification. All the modifications and alterations within the scope of the claims are to be construed as being covered by the claims.

We claim:

1. A combination stamp comprising a plurality of stamp elements, each stamp element including a stamp frame having upper and lower ends and a stamp plate provided in the lower end of the stamp frame, each stamp frame having a pair of opposed side surfaces and a pair of opposed end surfaces, one of the end surfaces of each stamp frame including a dovetail projection extending upwardly from the lower end of the frame and the other end surface of each stamp frame having a dovetail groove extending upwardly from the lower end of the frame, each pair of adjacent stamp elements being interlocked against relative horizontal movement by the receipt of the dovetail projection of one of the stamp elements in the dovetail groove of the other of the stamp elements, each of the opposed side surfaces of each stamp frame having a groove extending between the opposed end surfaces adjacent the upper end of the stamp frame and aligned with the grooves of the other stamp frames, and a generally channel-shaped holding member having a central portion extending over the upper ends of the stamp frames and a pair of parallel end edges, the end edges of the holding member being removably received in the aligned grooves on each of the side surfaces of the stamp frames to prevent relative vertical displacement of the stamp elements.

2. The combination stamp of claim 1 wherein the stamp frame is in the form of a rectangular tube having a top wall relative to the stamp plate, the top wall being formed with an ink supply inlet, the stamp frame having a hollow interior serving as an ink reservoir, the stamp plate being made of microporous sponge, an ink retaining member in the ink reservoir, the ink retaining member having a recess formed in its top surface relative to the stamp plate and opposing the ink supply inlet whereby ink poured through the ink supply inlet will flow into the recess and the top surface of the ink retaining member will be maintained free of ink.

3. The combination stamp of claim 1 in which each stamp frame includes a rectangular tube removably mounted therein for holding the stamp plate, a cartridge-supporting tube member positioned within the rectangular tube and extending upwardly from the stamp plate, and a tubular ink cartridge positioned in and supported by the cartridge-supporting tube, the ink cartridge including an ink retaining member which is in contact with the stamp plate for transferring ink to the stamp plate.

4. A combination stamp comprising a plurality of stamp elements, each stamp element including a stamp frame having upper and lower ends and a stamp plate provided in the lower end of the stamp frame, each stamp frame having a pair of opposed side surfaces and a pair of opposed end surfaces, one of the end surfaces of each stamp frame including a dovetail projection extending upwardly from the lower end of the frame and the other end surface of each stamp frame having a dovetail groove extending upwardly from the lower end of the frame, each pair of adjacent stamp elements being interlocked against relative horizontal movement by the receipt of the dovetail projection of one of the stamp elements in the dovetail groove of the other of the stamp elements, each of the opposed side surfaces of each stamp frame having a groove extending between the opposed end surfaces adjacent the upper end of the stamp frame and aligned with the grooves of the other stamp frames, and a generally channel-shaped holding member having a central portion extending over the upper ends of the stamp frames and a pair of parallel end edges, the end edges of the holding member being removably received in the aligned grooves on each of the side surfaces of the stamp frames to prevent relative vertical displacement of the stamp elements, the stamp frame being in the form of a rectangular tube having a top wall relative to the stamp plate, the top wall being formed with an ink supply inlet, the stamp frame having a hollow interior serving as an ink reservoir, the stamp plate being made of microporous sponge, a cap closing the ink supply inlet, the cap comprising a tubular main body having a top wall relative to the stamp plate provided with an air port, an annular elastic member retained in the main body of the cap, a first air-permeable liquid-impermeable layer disposed in the main body transversely thereof and adhered to the upper surface of the annular elastic member, a second air-permeable liquid-impermeable layer provided in face-to-face relation to the first layer and adhered to the lower surface of the annular elastic member whereby a space is formed between the two layers.

* * * * *